United States Patent [19]

Yasugahira et al.

[11] 4,208,167

[45] Jun. 17, 1980

[54] BLADE LATTICE STRUCTURE FOR AXIAL FLUID MACHINE

[75] Inventors: Norio Yasugahira; Takeshi Sato, both of Hitachi; Kuniyoshi Tsubouchi, Kashiwa, all of Japan

[73] Assignee: Hitachi, Ltd., Tokyo, Japan

[21] Appl. No.: 945,054

[22] Filed: Sep. 22, 1978

[30] Foreign Application Priority Data

Sep. 26, 1977 [JP] Japan ..... 52/114631

[51] Int. Cl.[2] ..... F04D 29/54; F01D 9/02

[52] U.S. Cl. ..... 415/217; 417/DIG. 1

[58] Field of Search ..... 415/181, 191, 193, 216, 415/217, 218, DIG. 1

[56] References Cited

U.S. PATENT DOCUMENTS

| | | | |
|---|---|---|---|
| 2,650,752 | 9/1953 | Hoadley | 415/DIG. 1 |
| 2,735,612 | 2/1956 | Hausmann | 415/DIG. 1 |
| 2,801,790 | 8/1957 | Doll, Jr. | 415/217 |
| 2,938,662 | 5/1960 | Eckert et al. | 415/DIG. 1 |
| 3,529,631 | 9/1970 | Riollet | 415/DIG. 1 |
| 4,023,350 | 5/1977 | Hovan et al. | 415/DIG. 1 |

FOREIGN PATENT DOCUMENTS

| | | | |
|---|---|---|---|
| 1110068 | 2/1956 | France | 415/193 |

*Primary Examiner*—Leonard E. Smith
*Attorney, Agent, or Firm*—Craig & Antonelli

[57] ABSTRACT

In a blade lattice structure for an axial fluid machine including circumferentially arranged stationary blades and upper and lower side walls having the stationary blades secured thereto for defining therebetween a flow path which is arranged annularly, the stationary blades each have a cross sectional shape such that the thickness of each stationary blade gradually increases in going toward the upper side wall from an arbitrarily selected position on the blade in its height, so that the area of a throat for each section of the stationary blade is varied along the height thereof to thereby increase stage efficiency.

10 Claims, 10 Drawing Figures

BLADE LATTICE STRUCTURE FOR AXIAL FLUID MACHINE

BACKGROUND OF THE INVENTION

This invention relates to blade lattice structures for axial fluid machines, and more particularly to a blade lattice structure for an axial fluid machine, such as a steam turbine, gas turbine, axial compressor, etc., which has a defined annular flow path.

Generally, when an operating fluid flows through a blade lattice structure which constitutes a stage of an axial flow machine, the operating fluid loses its energy due to friction with the surfaces of blades and side walls constituting the blade lattice structure. These losses are generally referred to as profile losses and side wall losses, of which the side wall losses are attributed to mutual interference of boundary layers on the surfaces of the blades, boundary layers on the surfaces of the side walls and secondary flows in the flow path of the blade lattice structure, and cause a reduction to occur in stage efficiency in the axial fluid machine. It is essential to reduce the side wall losses in order to increase the efficiency of a compact axial fluid machine, particularly high and medium pressure stages of a steam turbine and a gas turbine which have a small aspect ratio (blade chord lengths/blade heights).

Proposals have hitherto been made for reducing the side wall losses. Some of these proposals include the use of following arrangements:

(1) Attaching shield plates to side walls.

(2) Throttling side walls.

(3) Controlling boundary layers.

It is to be noted that since the arrangements hitherto suggested are all intended to reduce secondary flows by merely considering the two dimentional characteristics of a blade lattice structure and no consideration is paid to the three dimensional characteristics of a well-known axial fluid machine or the flow characteristics of a fluid flowing through a blade lattice structure forming an annular flow path, no appreciable increase in stage efficiency has ever been obtained.

The mechanism of production of secondary flows in a blade lattice structure forming an annular flow path in a stage of an axial-flow turbine will be discussed. Considering a flow in an outlet flow path of a stationary blade, it is noted that, in an annular flow path defined by upper and lower walls of a diaphragm having the stationary blade secured thereto and an adjacent stationary blade, boundary layers formed along the wall surfaces of the diaphragm, boundary layers formed along the leading and trailing edges of the stationary blade and a cross flow directed from the trailing edge toward the leading edge of the stationary blade interfere with one another, with a result that secondary flows are produced near the upper wall surface and lower wall surface of the diaphragm. According to our experience, this phenomenon is such that the secondary flow along the upper wall surface of the diaphragm is on a larger scale than the secondary flow along the lower wall surface of the diaphragm. More specifically, owing to the secondary flows produced in a flow path defined between the two adjacent stationary blades, the total pressure loss of the stationary blade is distributed such that the losses occurring in the vicinity of the blade tip located radially outwardly of the turbine and in the vicinity of the blade root located radially inwardly of the turbine are much greater than the loss occurring in the central portion of the flow path. The phenomenon particularly noteworthy in a blade lattice structure forming an annular path is that the loss at the blade tip is greater than that at the blade root. In some cases, the loss at the blade tip amounts to several times as great as the loss at the blade root. This phenomenon should be avoided in order to increase stage efficiency.

This phenomenon has escaped one's attention in the past because the flow of a fluid in a blade lattice structure has been considered as a two dimensional phenomenon. More specifically, in an annular flow path which is a three dimensional flow, a balance should be established between the centrifugal forces exerted by a fluid and the pressure applied radially by such fluid. This makes the pressure high at the blade tip which is located radially outwardly of the turbine and low at the blade root which is located radially inwardly of the turbine. Thus, this radial differential pressure promotes the tendency of a secondary flow being produced in the vicinity of the blade tip. The secondary flow which shows a marked development at the tip of a stationary blade not only causes a marked reduction in the efficiency of the stationary blade but also worsens the condition of the flow of the fluid toward the next following movable blade. Consequently, such secondary flow would naturally reduce stage efficiency.

SUMMARY OF THE INVENTION

An object of this invention is to reduce secondary flow losses which are produced in stationary blades of an axial fluid machine, thereby increasing the stage efficiency of the axial fluid machine.

Another object is to reduce profile losses by suppressing the development of a boundary layer in the vicinity of the tip of each stationary blade of an axial fluid machine, as well as to reduce secondary flow losses produced in the stationary blades of the axial fluid machine, thereby increasing the stage efficiency of the axial fluid machine.

The characterizing feature of this invention is that, in a blade lattice structure for an axial fluid machine including circumferentially arranged stationary blades and upper and lower side walls having the stationary blades secured thereto for defining therebetween a flow path which is arranged annularly, the stationary blades each have a cross sectional shape such that the thickness of each stationary blade gradually increases in going toward the upper side wall from an arbitrarily selected position on the blade in its height, so that the area of a throat for each section of the stationary blade is varied along the height thereof to thereby increase the stage efficiency of the axial fluid machine.

DESCRIPTION OF THE PREFERRED EMBODIMENT

A preferred embodiment of the invention will be described by referring to a blade lattice structured of an axial turbine.

Figure 1:
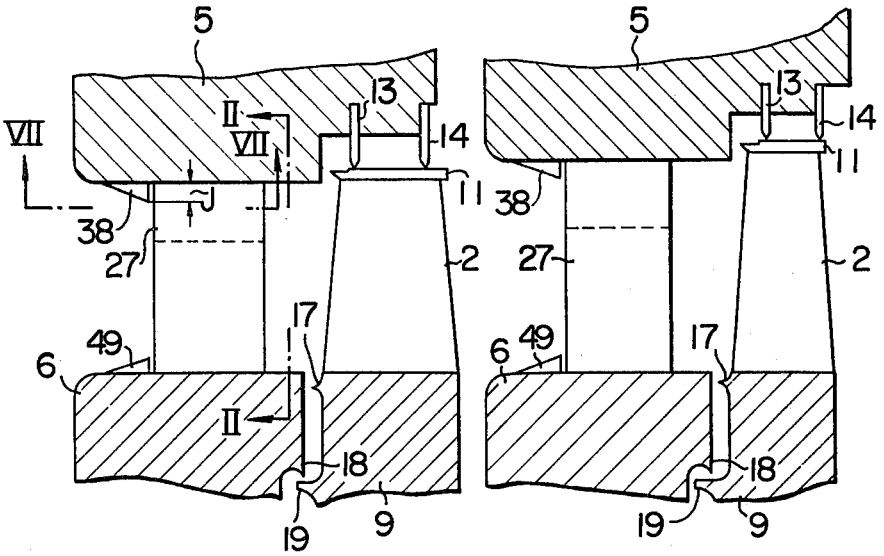
FIG. 1 is a sectional view, taken along the axis of a turbine, of the stage structure of a steam turbine comprising one embodiment of the invention.

In FIG. 1, a stage of a steam turbine includes stationary blades 27 which are arranged annularly, a diaphragm upper wall 5 and a diaphragm lower wall 6 of an annular shape located on the radially outer side and the radially inner side of the stationary blades 27 respectively and having the stationary blades 27 secured thereto, movable blades 2 corresponding to the stationary blades 27 and arranged annularly, the movable blades 2 being attached to a disk 9 of a rotor, not shown and leak preventing fins 13, 14, 17, 18 and 19.

Figure 2:
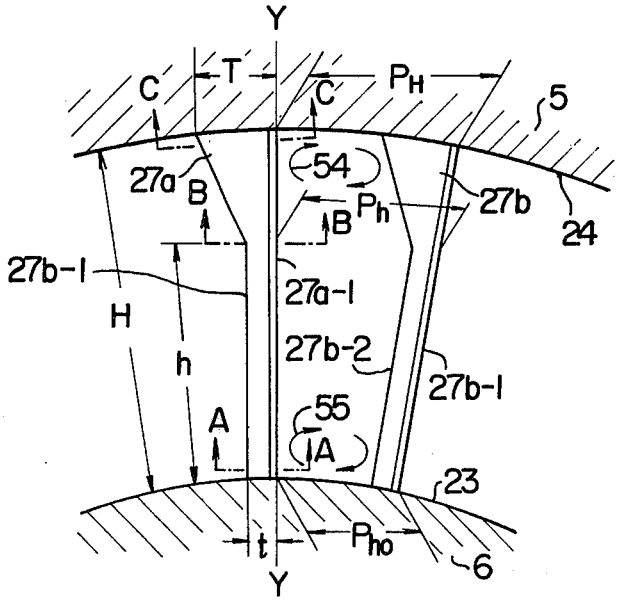
FIG. 2 is a view as seen in the direction of arrows II—II in FIG. 1.

FIG. 2 is a view as seen in the direction of the arrows II—II in FIG. 1, in which the stationary blades 27 are viewed circumferentially from the outlet side. In FIG. 2, the stationary blades 27*a* and 27*b* surrounded by the diaphragm upper wall 5 and diaphragm lower wall 6 and arranged circumferentially in equidistantly spaced apart relation have leading edges 27*a*-1 and 27*b*-1 respectively which form a straight line (Y—Y line) from the root to the tip. Meanwhile the stationary blades 27*a* and 27*b* also have trailing edges 27*a*-2 and 27*b*-2 respectively which are contoured such that no changes occur from a surface 23 of the diaphragm lower wall 6 to a position located at an arbitrarily selected height h, with the thickness t of the blades 27*a* and 27*b* being constant from the surface 23 to the position at the height h. However, the stationary blades 27*a* and 27*b* have their thicknesses gradually increased in going from the arbitrarily selected position at the height h toward a surface 24 of the diaphragm upper wall 5 located radially outwardly of the turbine until the thickness of the blades reach T at the wall surface 24. The rate of an increase in the thickness of the stationary blades T/t in the direction of the height thereof is advantageously obtained from the relation $$T/t \propto P_H/P_h$$

where $P_h$ is the pitch of the blades at the height h and $P_H$ is the pitch of the blades at the height H.

Therefore, if the pitch of the blades at the blade root is denoted by $P_{ho}$, it is possible to remove the influence which would otherwise be exerted by an increase in the pitch from the blade root to the blade tip $P_{ho} < P_h < P_H$ due to the flow path being annular. Thus, it is possible to provide improvements in a secondary flow phenomenon which occurs in the stationary blades of the prior art construction. More specifically, since the area of the throat of the blade lattice is varied successively in going from the blade height h to the upper wall surface 24, the flow is not accelerated as it approaches the blade tip which is connected to the diaphragm upper wall surface 24. As a result, the pressure is not maximized at the blade tip and the pressure differential along the blade height is minimized, thereby minimizing the flow of a fluid. Thus, a secondary flow 54 near the blade tip is substantially at the same level as a secondary flow 55 near the blade root as shown in FIG. 2. It is believed that the losses caused by the production of secondary flows would be greatly reduced. The position at the height h of the blade at which the blade thickness t begins to increase is located at approximately three-quarters the total height H of the blade from the surface 23 of the lower diaphragm wall 6 on the side of the blade root.

Figure 3:
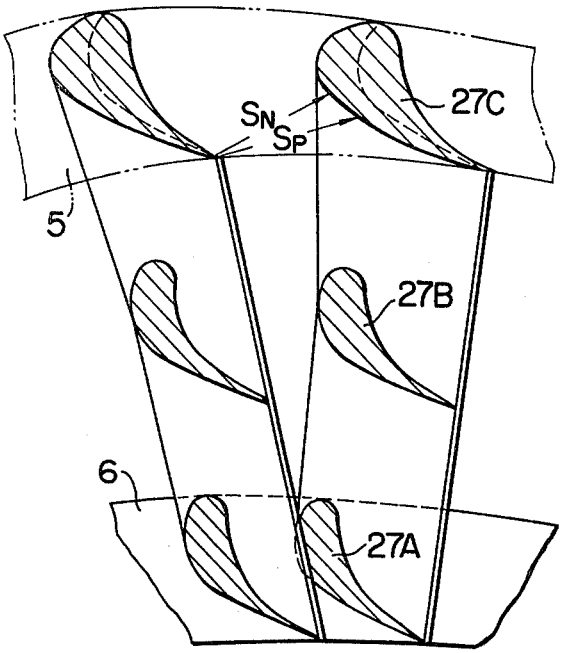
FIG. 3 is a bird's-eye view of the stationary blades shown in FIG. 1.

FIG. 3 is a bird's-eye view of the blades incorporating therein the present invention, showing the blades from their root to their tip. The shapes of the blades shown in sections 27A and 27B in FIG. 3 correspond to those of A—A and B—B sections shown in FIG. 2, and there is no change in shape between these two shapes. However, the shape of the blades shown in section 27C, which corresponds to the shape of section C—C shown in FIG. 2, indicates that in this section the thickness of each blade at the trailing edge is greater than that in the sections A—A and B—B, and that the throat defined between the adjacent two stationary blades is narrowed from $S_P$ in conventional stationary blades to $S_N$ in the stationary blades according to the invention.

Figure 4:
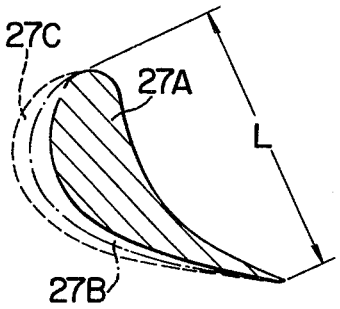
FIG. 4 is a sectional view of the blade showing the cross sectional shape of the stationary blades shown in FIG. 3.

FIG. 4 shows, in more concrete form, the changes in the blade profile brought about by the invention. It will be seen in this figure that in sections 27A, 27B and 27C of the blades shown in FIG. 3 there is no change in the shape of the leading edge but the protrusion on the trailing edge gradually increases in size with an attendant increase in thickness. Stated differently, the stationary blades according to the invention are contoured such that their thickness gradually increases while their chord length remains constant.

Figure 5:
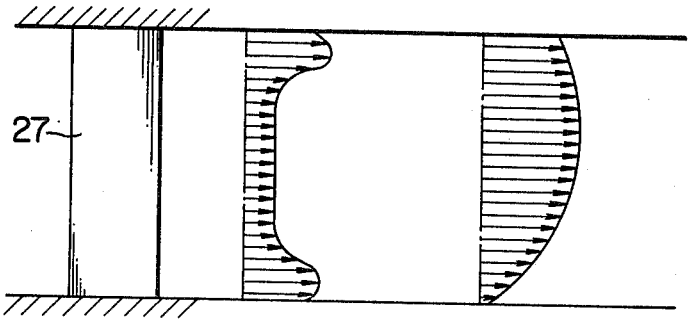
FIG. 5 is a diagrammatic representation of the loss distribution and the pressure distribution in the stationary blade according to the invention.

FIG. 5 diagrammatically shows the flow pattern which would ultimately be obtained with the stage structure incorporating therein the present invention. A study of the pressure distribution along the height of a blade shows that the pressure increases in going from the blade tip toward the blade root until a maximum pressure is obtained in a radial position located near the central portion of the flow path. From this radial position, the pressure decreases in going toward the blade root. This indicates that marked improvements would be provided in the secondary flow phenomenon in the vicinity of the blade tip and that a secondary flow loss in this region would be reduced to the same level as that occurring in the vicinity of the blade root.

By using the stage structure described hereinabove, it is possible to reduce secondary flow losses occurring at end portions of a stationary blade lattice constituting a stage of an axial fluid machine having a small aspect ratio, such as a steam turbine, gas turbine, compressor, etc., and to markedly improve the performance of such axial fluid machine. Particularly when the invention is applied to a steam turbine for generating power, it is expected that turbine efficiency would show an increase of about 0.5%.

Figure 6:
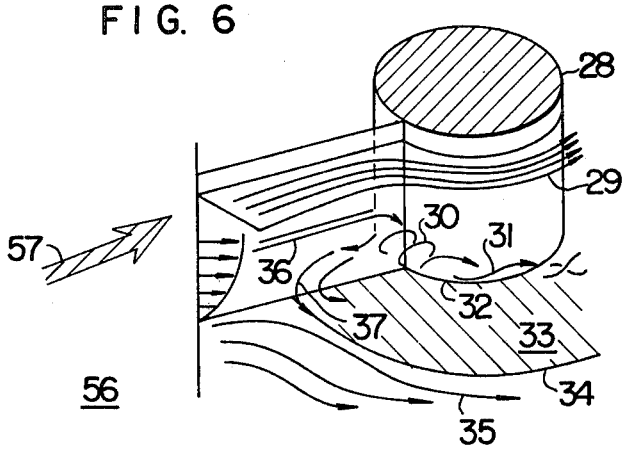
FIG. 6 is a view showing a fluid flow pattern at the bottom of a column.

A stage structure offering another feature intended to further increase stage efficiency will now be described. Prior to the description of this feature, a complex flow phenomenon will be outlined which has bearings on profile losses and occurs at the boundary between a stationary blade and a side wall. FIG. 6 shows a flow pattern of a fluid around a column placed on a planar wall and a portion of the column near the wall surface. A flow 57 directed to the column 28 branches into a main flow 29 and an impinging flow 36 upstream of the column 28 due to the presence of a boundary layer between a wall surface 56 and the column 28. The impinging flow 36 further branches into a vortical flow 30 produced by the interference of the impinging flow 36 with a flow in the boundary layer, and a reverting flow 37. The vortical flow 30 further develops into a vortical mass 31 which passes on to the downstream side of the column 28 while further growing in size. Meanwhile the reverting glow 37 further interferes with the boundary layer along the planar wall surface 56 to form a bottom turbulent flow region 33 between a base 32 of the column 28 and a boundary 34 on the planar wall surface 56, thereby further complicating this sort of flow pattern.

It would be naturally thought that the flow phenomenon occurring in the joint of the column 28 and the planar wall 56 would also occur in the boundary between the front edge of each stationary blade 27 and the upper diaphragm side wall 5. Means provided by the invention for avoiding the occurrence of this complex flow phenomenon to enable the stage structure according to the invention to achieve greater effects will be described by referring to FIGS. 1 and 7 to 9.

Figure 7:
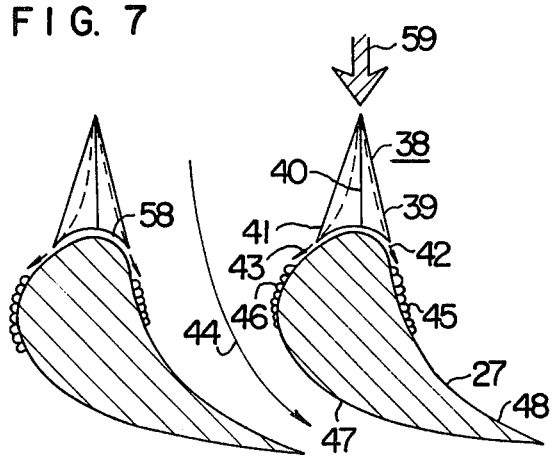
FIG. 7 is a sectional view taken along the line VII—VII in FIG. 1.

In FIG. 1 and 7, a wedge-shaped member 38 having an arbitrarily selected height J is provided on the surface of the upper diaphragm side wall 5 upstream of the front edge of each stationary blade 27. The wedge-shaped member 38 has triangular surfaces defined by a bottom line 39, a ridge 40, a bottom line 41 and side lines 58. A flow 59 directed to each stationary blade 27 in the vicinity of the upper diaphragm side wall 5 slides downwardly along the surfaces of the wedge-shaped member 38 and branches into flows 42 and 43 which pass along a leading edge 48 and a trailing edge 47 respectively of the stationary blade 27, without directly impinging on the front edge of the blade 27. The sliding flows 42 and 43 slide along the inclined surfaces of the wedge-shaped member 38 and then pass along the blade surfaces while being accelerated, thereby achieving the effects of reducing the thickness of a boundary layer 45 on the leading edge 48 and a boundary layer 46 on the trailing edge 47 and avoiding the production of boundary layers on the downstream side.

Figure 8:
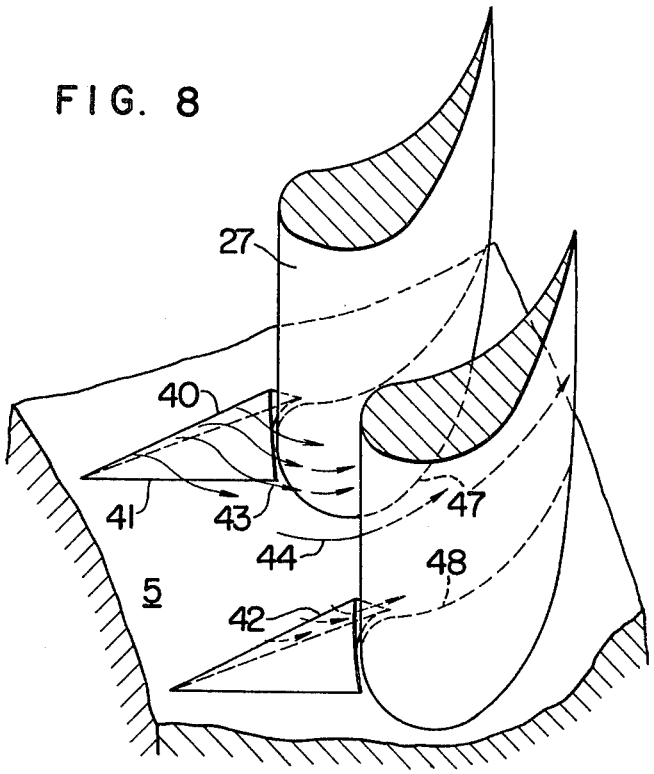
FIG. 8 is a bird's-eye view of the boundary zone at the front edge of each stationary blade shown in FIG. 7.
Figure 9:
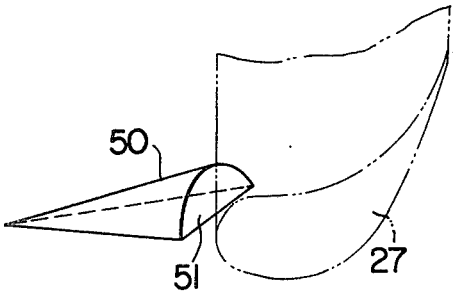
FIGS. 9 and 10 are fragmentary views showing modifications of the wedge-shaped member shown in FIG. 7.

The aforementioned flow pattern could be understood more clearly by referring to FIG. 8 which shows the fluid flow in three dimensions. FIGS. 7 and 8 show an example of the stage structure in which the wedge-shaped members are provided on the upper diaphragm side wall 5 relative to the stationary blades 27. However, it is to be understood that the invention is not limited to this example and that wedge-shaped members 49 could be provided on the lower diaphragm side wall 6 as shown in FIG. 1. The provisions of the wedge-shaped members 49 would not only prevent the development of boundary layers near the roots of the stationary blades 27 but have the effect of reducing secondary flow losses.

Figure 10:
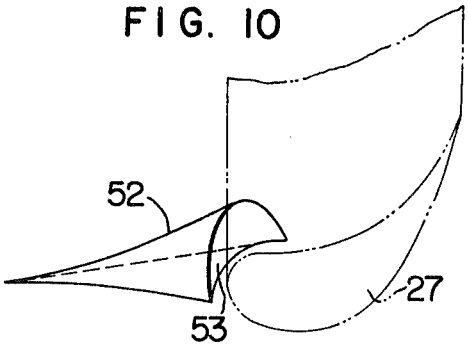

The boundary layer production preventing member mounted upstream of the front edge of each stationary blade is not limited to the wedge-shaped member 38. It is to be understood that a half-cone member 50 and a hyperboloid member 52 shown in FIGS. 9 and 10 respectively can achieve the same effect as the wedge-shaped member 38.

From the foregoing description, it will be appreciated that the stage structure described above is capable of not only reducing secondary flow losses but also suppressing the development of boundary layers on the blade surfaces near the front edge of the blade, thereby reducing profile losses and increasing stage efficiency.

The invention has the effects of reducing secondary flow losses occurring in stationary blades of an axial fluid machine and of increasing the stage efficiency of such axial fluid machine.

What is claimed is:

1. A blade lattice structure for an axial fluid machine comprising:
   - a plurality of static blades arranged circumferentially of the machine;
   - an upper side wall and a lower side wall having said stationary blades secured thereto at blade tips and blade roots respectively; and
   - an annular flow path defined between outer surfaces of said stationary blades and said side walls; wherein the improvement comprises:
   - an arrangement whereby said stationary blades each have a cross sectional shape such that the thickness of each stationary blade increases in going toward a surface of said upper side wall from an arbitrarily selected position on the blade spaced radially of the machine from a surface of said lower side wall, whereby the area of a throat for each section of the stationary blade can be varied along its height.

2. A blade lattice structure as claimed in claim 1, wherein the area of the throat for each section of the stationary blade is varied such that the area gradually decreases in going from said arbitrarily selected position on the blade toward said surface of said upper side wall.

3. A blade lattice structure as claimed in claim 1, wherein said arbitrarily selected position on the blade from which the cross sectional shape is varied to have its thickness increased is a position which is spaced apart from said surface of said lower side wall a distance corresponding to about three-quarters the total height of the stationary blade.

4. A blade lattice structure as claimed in claim 1, wherein the increase in the thickness of each stationary blade is achieved by increasing the dimension of a protuberance on a trailing edge of the stationary blade.

5. A blade lattice structure as claimed in claim 1, wherein each said stationary blade has its thickness gradually increased without having its chord length varied.

6. A blade lattice structure as claimed in claim 1, wherein the rate of the increase in the thickness of each said stationary blade along the height thereof is proportional to the rate of an increase in the circumferential pitch of said static blades from the blade roots to the blade tips.

7. A blade lattice structure as claimed in claim 1, wherein the improvement further comprises a projecting member of an arbitrarily selected height mounted on at least one of said surfaces of said upper and lower side walls upstream of a front edge of each said stationary blade.

8. A blade lattice structure as claimed in claim 7, wherein said projecting member is in the form of a wedge.

9. A blade lattice structure as claimed in claim 7, wherein said projecting member is in the form of a half cone.

10. A blade lattice structure as claimed in claim 7, wherein said projecting member is in the form of a hyperboloid.

* * * * *